US007143530B2

(12) United States Patent
Hudson et al.

(10) Patent No.: US 7,143,530 B2
(45) Date of Patent: Dec. 5, 2006

(54) SOCCER SHOE HAVING INDEPENDENTLY SUPPORTED LATERAL AND MEDIAL SIDES

(75) Inventors: Peter A. Hudson, Portland, OR (US); Erez Morag, Beaverton, OR (US); Timm A. Flintoff, Taichung (TW)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/260,479

(22) Filed: Oct. 28, 2005

(65) Prior Publication Data

US 2006/0064905 A1 Mar. 30, 2006

Related U.S. Application Data

(63) Continuation of application No. 10/626,841, filed on Jul. 25, 2003, now Pat. No. 6,973,746.

(51) Int. Cl.
*A43B 5/02* (2006.01)

(52) U.S. Cl. ..... 36/128; 36/67 A

(58) Field of Classification Search ..... 36/128, 36/67 A, 67 R, 67 B, 134, 67 D
See application file for complete search history.

(56) References Cited

U.S. PATENT DOCUMENTS

| | | | | |
|---|---|---|---|---|
| 2,353,829 | A | 7/1944 | Jakosky | |
| 3,081,774 | A | 3/1963 | Lelyveld | |
| 4,316,334 | A | 2/1982 | Hunt | |
| D272,772 | S | 2/1984 | Kohno | |
| 4,494,320 | A | 1/1985 | Davis | |
| D278,760 | S | 5/1985 | Norton et al. | |
| 4,574,498 | A | 3/1986 | Norton et al. | |
| 4,638,576 | A * | 1/1987 | Parracho et al. | 36/68 |
| D290,903 | S | 7/1987 | Inohara et al. | |
| D295,231 | S | 4/1988 | Heyes | |
| 4,766,679 | A | 8/1988 | Bender | |
| 4,843,735 | A | 7/1989 | Nakanishi | |
| 4,914,838 | A | 4/1990 | Ihlenburg | |

(Continued)

FOREIGN PATENT DOCUMENTS

| | | |
|---|---|---|
| EP | 1 092 358 | 4/2001 |

(Continued)

OTHER PUBLICATIONS

International Search Report from PCT/US2004/018929.

(Continued)

*Primary Examiner*—Ted Kavanaugh
(74) *Attorney, Agent, or Firm*—Banner & Witcoff, Ltd.

(57) ABSTRACT

A soccer shoe includes an upper and a cleat assembly coupled to the upper. The cleat assembly further includes a medial support bar located on the medial side and a lateral support bar located on the lateral side. A portion of the cleat assembly located near a midfoot section of the medial support bar is stiffer than a portion of the cleat assembly located near a midfoot section of the lateral support bar. The medial support bar extends approximately from a region corresponding to the rear of the calcaneous of a properly fitted wearer to approximately the head of the first metatarsal of the wearer. The lateral support bar extends approximately from a region corresponding to the rear of the calcaneous of the wearer to approximately the head of the fifth metatarsal of the wearer. The cleat assembly is bonded to a cushioning midsole formed from heated and compressed ethylene vinyl acetate foam. The upper lacks a full-length lasting board and is bonded directly to the cushioning midsole. A lining covers a padded collar and extends inside a foot-receiving region of the shoe, with a portion of the foot-receiving region around a wearer's heel being substantially free of discontinuities.

9 Claims, 13 Drawing Sheets

U.S. PATENT DOCUMENTS

| | | | | |
|---|---|---|---|---|
| 5,367,791 | A | | 11/1994 | Gross et al. |
| 5,375,346 | A | | 12/1994 | Cole et al. |
| 5,416,986 | A | | 5/1995 | Cole et al. |
| 5,452,526 | A | | 9/1995 | Collins |
| 5,461,801 | A | | 10/1995 | Anderton |
| D387,892 | S | | 12/1997 | Briant |
| D389,298 | S | | 1/1998 | Briant |
| D393,146 | S | | 4/1998 | Valle |
| 5,832,636 | A | * | 11/1998 | Lyden et al. ..... 36/59 R |
| 5,896,608 | A | * | 4/1999 | Whatley ..... 12/142 T |
| 5,987,783 | A | | 11/1999 | Allen et al. |
| 6,009,641 | A | | 1/2000 | Ryan |
| 6,018,891 | A | | 2/2000 | Duclos |
| D421,833 | S | | 3/2000 | Fallon |
| 6,108,943 | A | | 8/2000 | Hudson et al. |
| 6,167,640 | B1 | | 1/2001 | Schaefer |
| 6,199,303 | B1 | | 3/2001 | Luthi et al. |
| 6,226,897 | B1 | | 5/2001 | Sand |
| 6,298,582 | B1 | | 10/2001 | Friton et al. |
| 6,330,757 | B1 | | 12/2001 | Russell |
| 6,499,235 | B1 | | 12/2002 | Lussier et al. |
| 6,502,330 | B1 | | 1/2003 | David et al. |
| 6,810,605 | B1 | * | 11/2004 | Nakano et al. ..... 36/25 R |
| 6,973,746 | B1 | * | 12/2005 | Auger et al. ..... 36/128 |
| 2002/0104233 | A1 | * | 8/2002 | Fallon et al. ..... 36/50.1 |
| 2002/0166263 | A1 | * | 11/2002 | Sink ..... 36/127 |
| 2003/0029060 | A1 | * | 2/2003 | Hockerson et al. ..... 36/67 R |

FOREIGN PATENT DOCUMENTS

| | | |
|---|---|---|
| FR | 2 420 312 | 10/1979 |

OTHER PUBLICATIONS

Written Opinion of the ISA from PCT/US2004/018929.

"Air Jordan 15 Basketball Shoes"; printed from http://www.reviewboard.com/Section/Fitness/378: publication date unknown, but on or prior to Jun. 4, 2003.

"Catch Me If You Can"; printed from http://www.kickology.net/review/nike/zoomultraflight.html; publication date unknown, but on or prior to Jun. 4, 2003.

* cited by examiner

SOCCER SHOE HAVING INDEPENDENTLY SUPPORTED LATERAL AND MEDIAL SIDES

CROSS-REFERENCE TO RELATED APPLICATIONS

This application is a continuation of U.S. patent application Ser. No. 10/626,841, filed Jul. 25, 2003 now U.S Pat. No. 6,973,746 and titled "Soccer Shoe Having Independently Supported Lateral and Medial Sides." Said application is hereby incorporated by reference in its entirety.

FIELD OF THE INVENTION

The present invention generally relates to a cleated article of footwear. More specifically, the invention relates to a cleated article of footwear designed to address motions prevalent in the sport of soccer so as to enhance performance and prevent injuries.

BACKGROUND OF THE INVENTION

The modern athletic shoe is a combination of many elements which have specific functions, all of which must work together for the support and protection of the foot during an athletic event. Cleated athletic shoes, particularly soccer shoes, typically include a sole having an upper extending upwardly from the sole and into which the foot of the athlete is positioned and secured in place. The sole provides traction, protection, and a durable wear surface. In addition, a plurality of cleats are secured to the sole and extend downwardly from it to provide the traction of the shoe when the athlete runs on a ground surface. The design of athletic shoes has rapidly become a refined science. However, the advancement of that science as to cleated footwear has in some ways been less rapid and less developed.

The sport of soccer imposes special demands upon player footwear. In the modern game, players run increasingly long distances. In a 90 minute match, a player may run as much as (or more than) 14 kilometers (over 8.5 miles). When practice sessions are also considered, a player may run in excess of 70 kilometers (43.5 miles) per week while wearing soccer shoes. It is thus important that soccer shoes be as comfortable as possible.

The presence of cleats on the shoe sole presents additional problems in this regard. Specifically, cleats can cause point pressures on a player's foot, particularly when the player is running over a frozen playing field or other hard surface. Moreover, the relatively long distances that a player must run, in combination with the side-to-side motions, foot-planting motions (for kicking a ball) and other common motions, can cause a player to become even more fatigued and injury prone than the player might be from running alone.

Significant advances have been made in the design of a cleated athletic shoe for the game of soccer. Commonly-owned U.S. patent application Ser. No. 10/179,013 (titled Article of Footwear Having a Regional Cleat Configuration) describes different cleat designs for the lateral and medial portions of the shoe (particularly the sole) in order to enhance flexibility, balance control, propulsion, stability and support in the specific areas where needed. Commonly-owned U.S. patent application Ser. No. 10/179,014 (titled Article of Footwear Having Medial and Lateral Sides with Differing Properties) also describes varying cleat designs for the medial and lateral regions in order to improve performance. However, further advantages can be achieved.

Pronation, or the rolling of a foot from the outside to the inside during running, is of special interest. In particular, pronation occurs as a runner's foot strikes the ground on the outside (or lateral) edge of the foot and the foot then rolls inward so as to place the inner (or medial) edge on the ground. A certain amount of pronation is natural and necessary for normal running. However, excessive pronation can lead to fatigue and injuries.

SUMMARY OF THE INVENTION

Accordingly, the present invention further addresses the above considerations. In particular, the invention provides a cleated article of footwear that controls the motion of a wearer's foot during running, and that increases comfort and reduces fatigue. In one embodiment, a soccer shoe includes an upper and a cleat assembly coupled to the upper. The cleat assembly further includes a base having medial and lateral sides, a plurality of downwardly extending ground engaging members, a medial support bar located on the medial side and a lateral support bar located on the lateral side. A portion of the cleat assembly generally located near a midfoot section of the medial support bar is stiffer than a portion of the cleat assembly generally located near a midfoot section of the lateral support bar. In at least one embodiment, the medial support bar extends approximately from a region corresponding to the rear of the calcaneous of a properly fitted wearer to approximately the head of the first metatarsal of the wearer. Similarly, the lateral support bar extends approximately from a region corresponding to the rear of the calcaneous of the wearer to approximately the head of the fifth metatarsal of the wearer.

In other embodiments, a soccer shoe includes a cleat assembly, a cushioning midsole bonded to the cleat assembly and an upper lacking a full-length lasting board. The upper is bonded directly to the cushioning midsole. The cushioning midsole can be formed from heated and compressed ethylene vinyl acetate foam, also known as Phylon. The invention may further include a padded collar element and a lining covering the collar and extending inside a foot-receiving region of the shoe, with a portion of the foot-receiving region around a wearer's heel being substantially free of discontinuities. These and other features of the invention will be apparent upon consideration of the following detailed description of preferred embodiments.

DETAILED DESCRIPTION OF THE PREFERRED EMBODIMENTS

Figure 1:
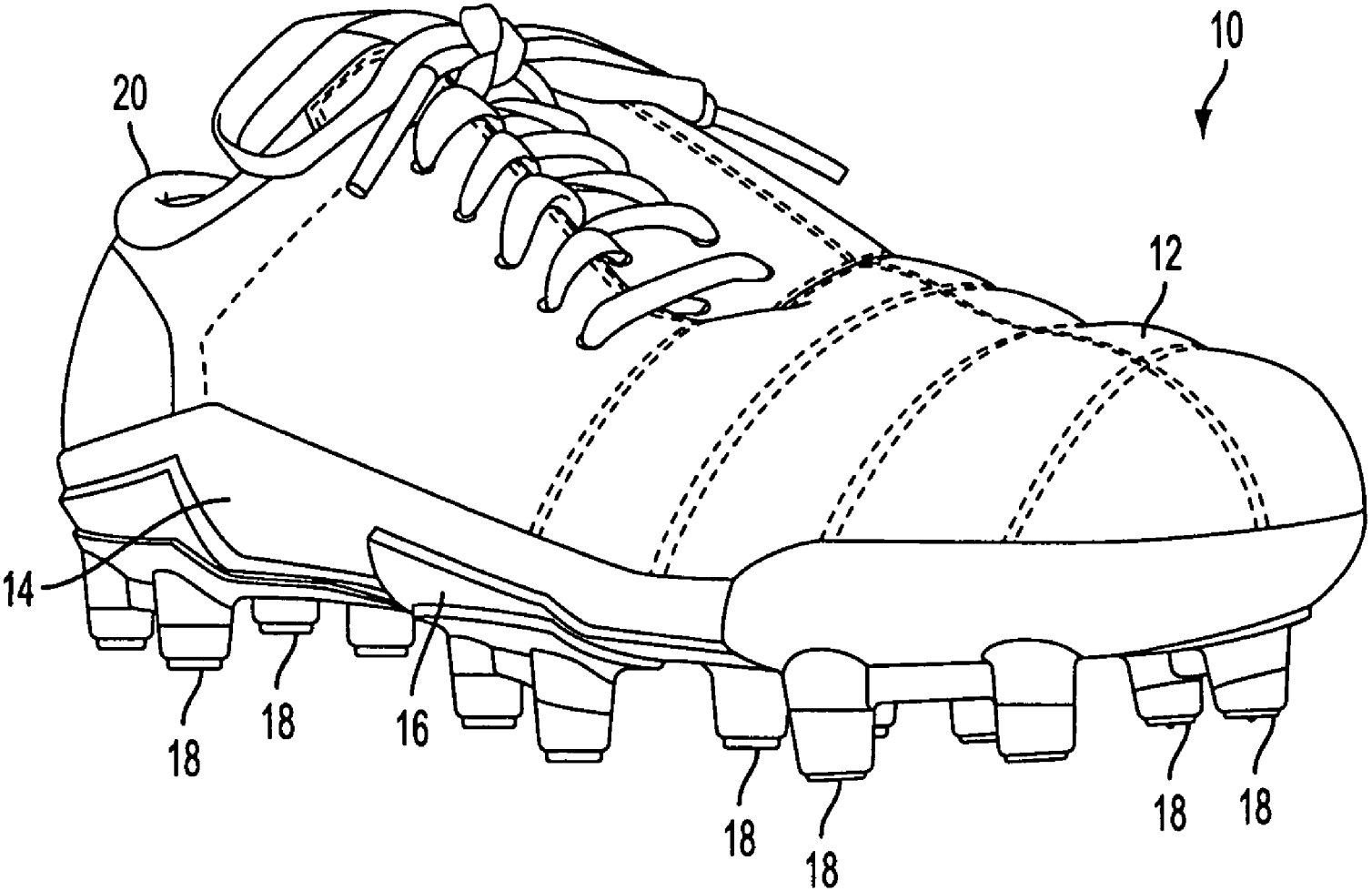
FIG. 1 is a lateral side perspective view of an article of footwear according to at least one embodiment of the invention.
Figure 2:
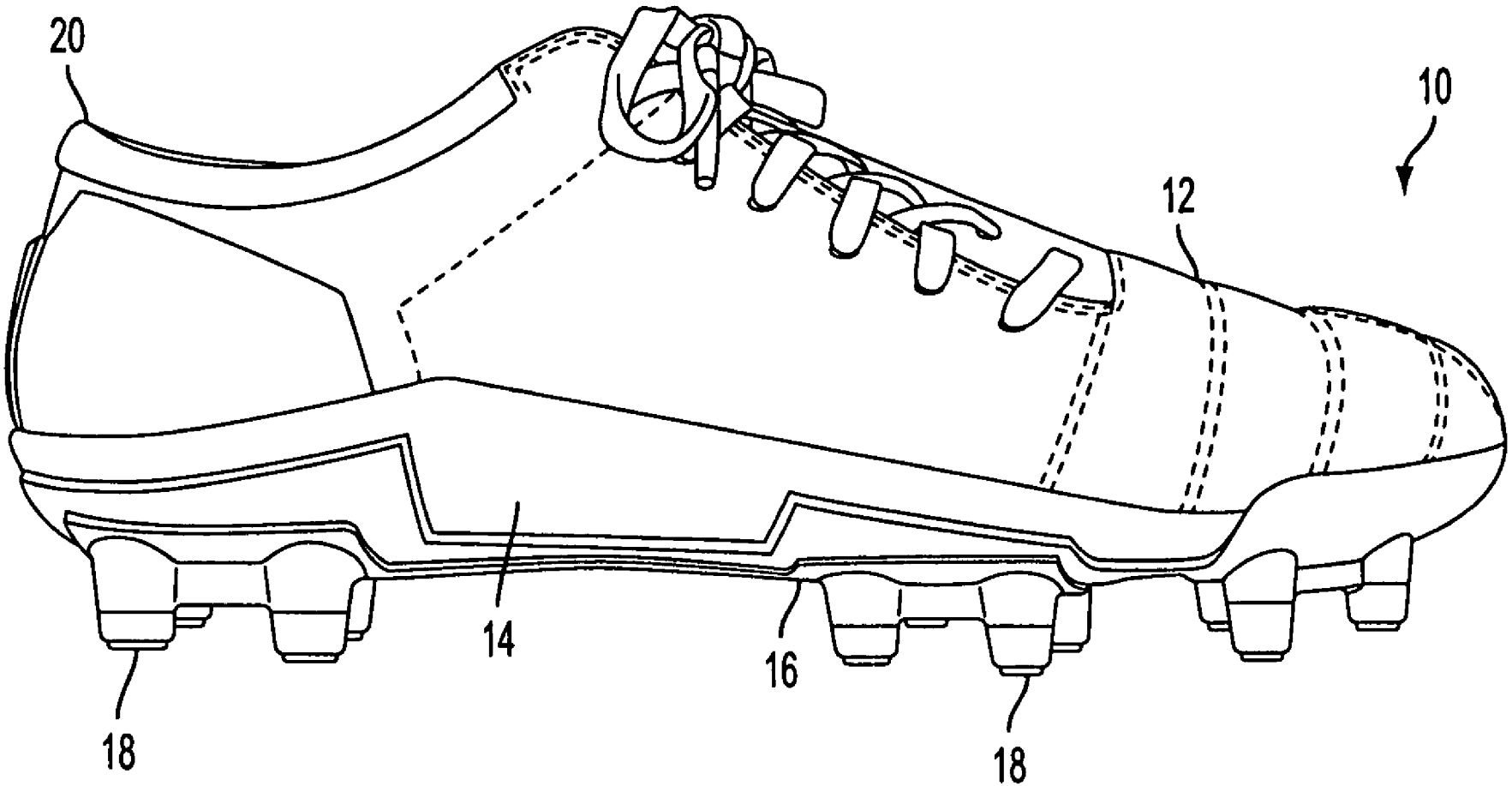
FIG. 2 is a lateral side elevational view of an article of footwear according to at least one embodiment of the invention.
Figure 3:
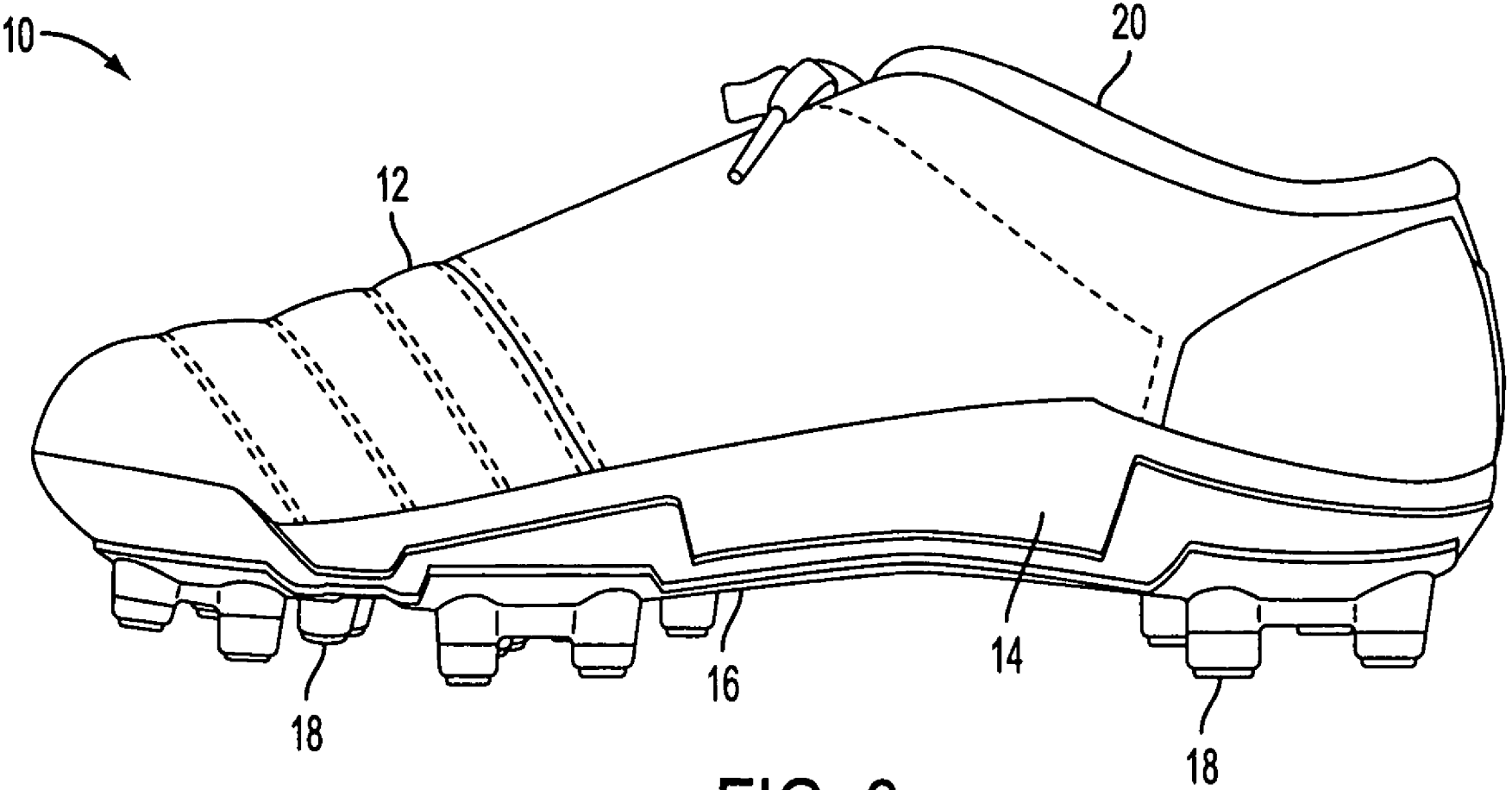
FIG. 3 is a medial side elevational view of an article of footwear according to at least one embodiment of the invention.
Figure 4:
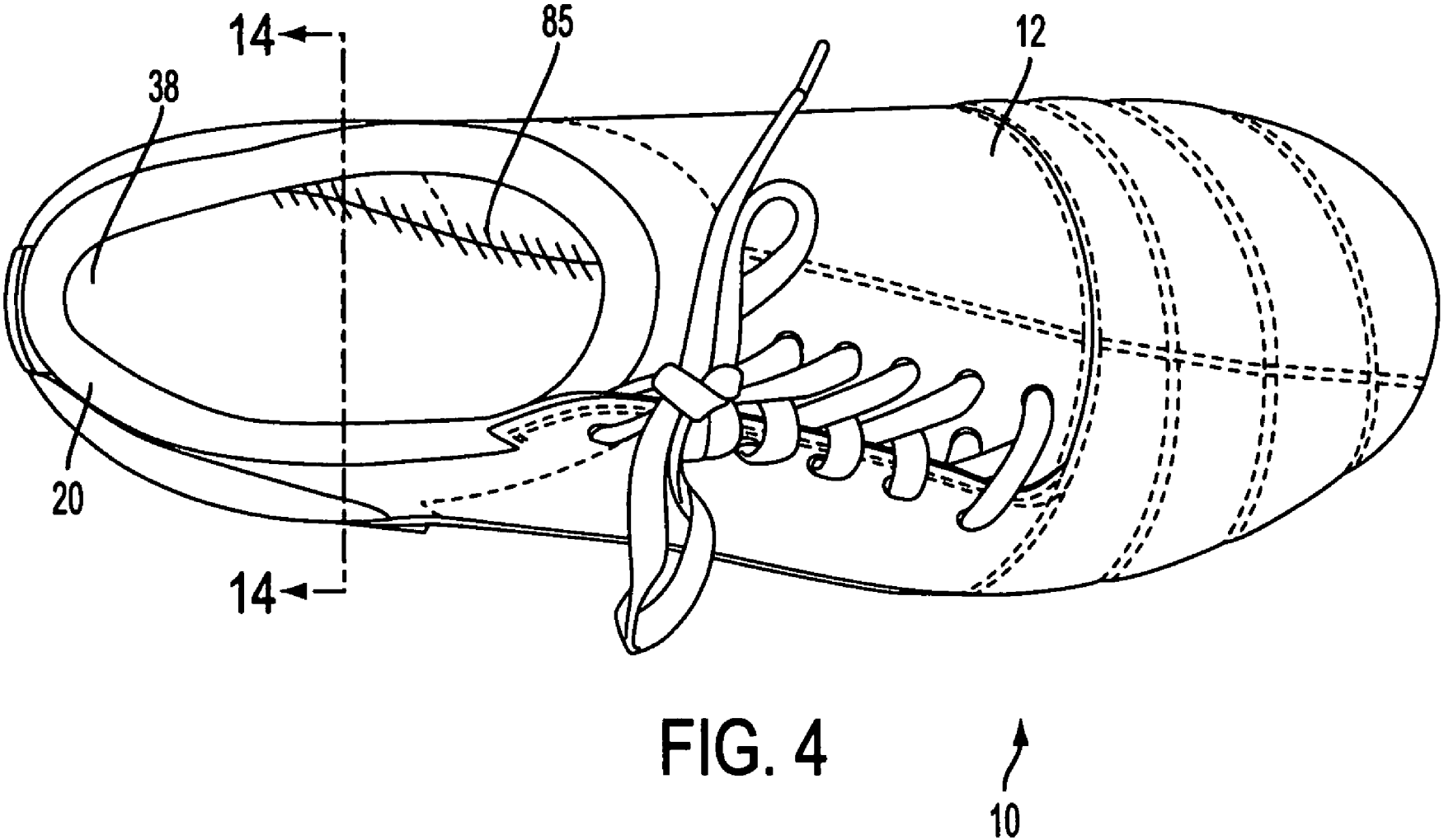
FIG. 4 is a top view of an article of footwear according to at least one embodiment of the invention.
Figure 5:
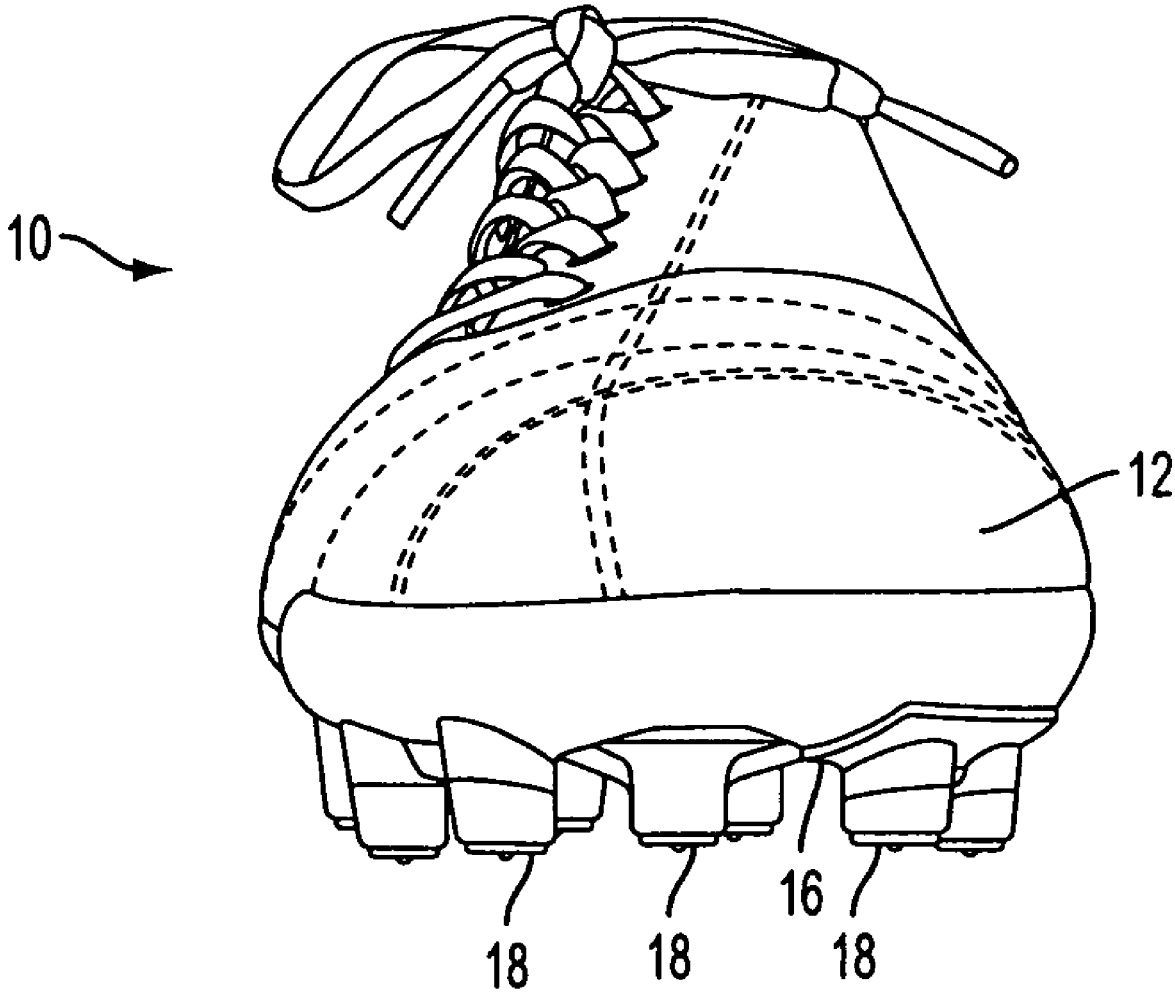
FIG. 5 is a front view of an article of footwear according to at least one embodiment of the invention.
Figure 6:
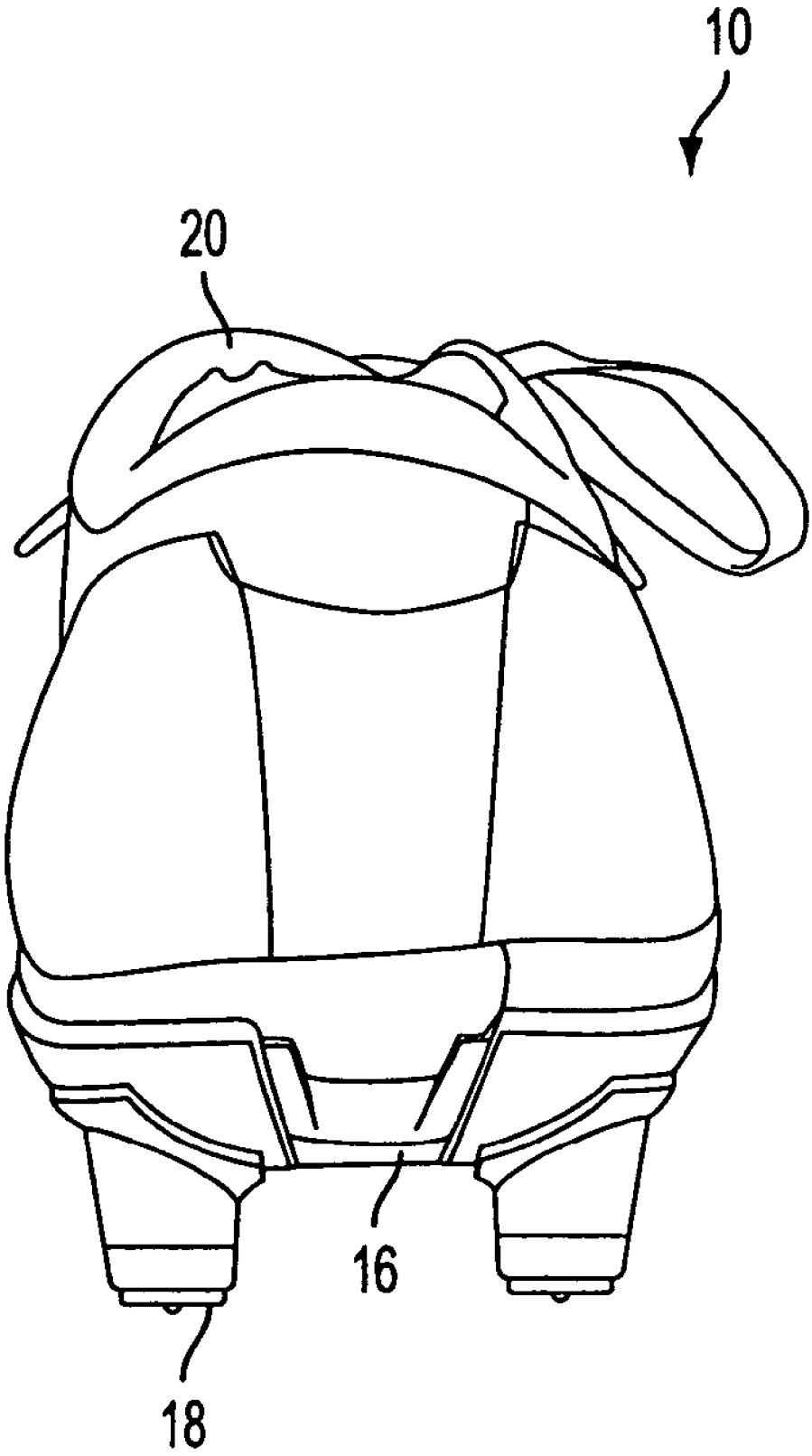
FIG. 6 is a rear view of an article of footwear according to at least one embodiment of the invention.

FIG. 1 is a lateral side perspective view of a cleated article of athletic footwear, for example a soccer shoe, according to at least one embodiment of the invention. Throughout this description, the article of footwear is generally referred to as shoe 10. As seen in FIG. 1, shoe 10 includes an upper 12. Upper 12 is attached to a midsole 14, which is in turn attached to a cleat assembly 16. Cleat assembly 16 includes multiple ground engaging members 18. When worn, ground-engaging members 18 provide traction to a player so as to enhance stability. FIG. 2 is a lateral side elevational view of shoe 10. When shoe 10 is worn, the lateral side of shoe 10 is generally oriented on the side facing away from the centerline of the wearer's body. FIG. 3 is a medial side elevational view of shoe 10. When shoe 10 is worn, the medial side generally faces toward the centerline of the wearer's body. FIG. 4 is a top view of shoe 10 (with no sock liner in place), and further shows upper 12. Upper 12 includes a padded collar 20. In at least one embodiment, upper 12 is tongueless, with the upper wrapping from the medial side of the wearer's foot, over the top of the foot, and under the lateral side portion of the upper. The laces of shoe 10 are located on the lateral side. FIGS. 5 and 6 are, respectively, front and rear elevational views of shoe 10.

Figure 7:
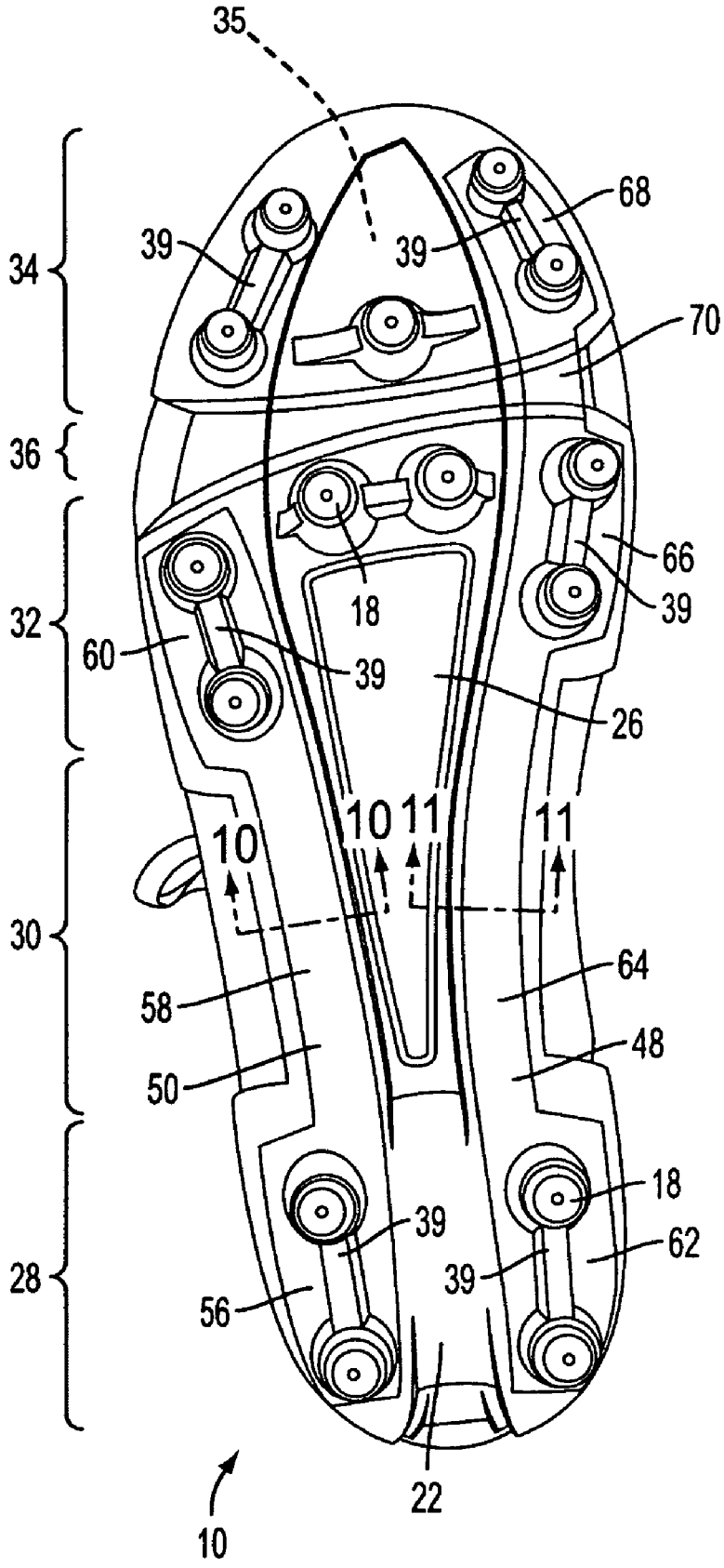
FIG. 7 is a bottom view of an article of footwear according to at least one embodiment of the invention.
Figure 8:
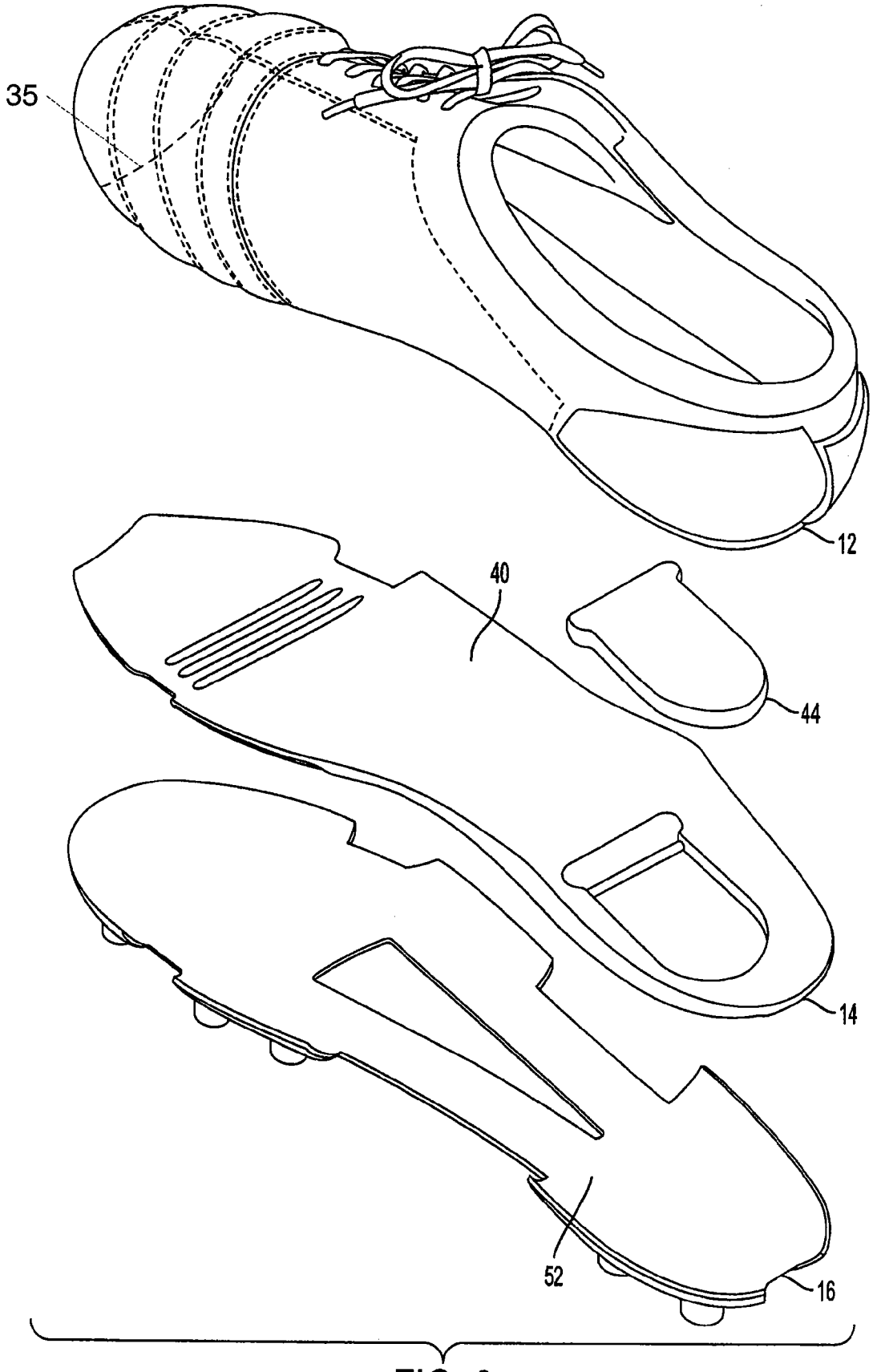
FIG. 8 is an exploded perspective view of an article of footwear according to at least one embodiment of the invention.
Figure 9:
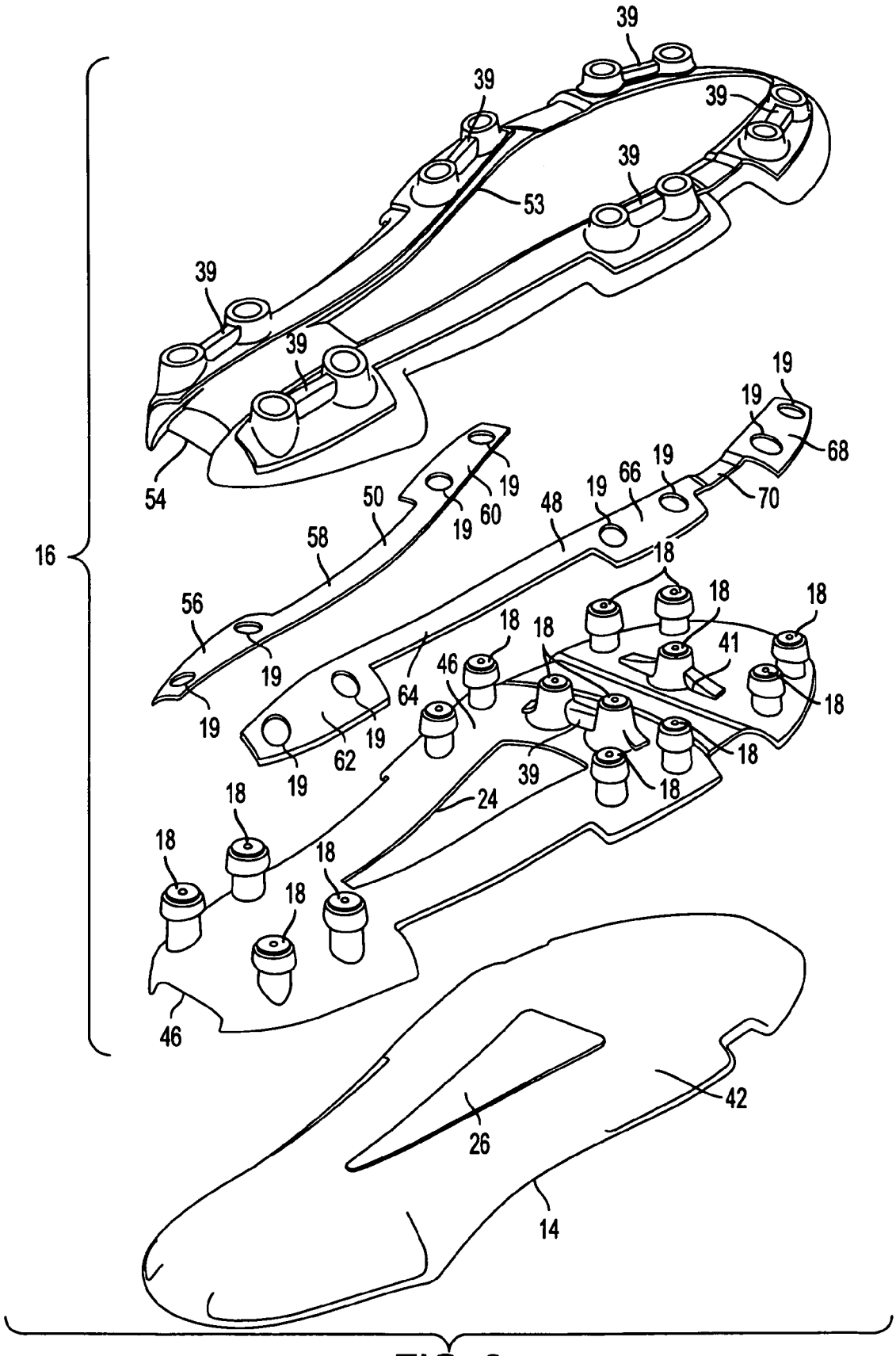
FIG. 9 is an inverted exploded perspective view of outsole and midsole components of an article of footwear according to at least one embodiment of the invention.

FIG. 7 shows the outsole 22 of shoe 10. As seen more clearly in FIG. 9, a major portion of outsole 22 is formed by cleat assembly 16. In at least one embodiment, and as shown in FIGS. 8 and 9, cleat assembly 16 includes at least one open region 24. When cleat assembly 16 and midsole 14 are joined, outsole 22 thus includes the lower exposed surfaces of cleat assembly 16 and an exposed portion 26 of midsole 14 that is exposed by open region 24. The exposed portion 26 is centrally disposed in the midfoot and forefoot regions 30, 32 of the outsole 22; because the exposed portion 26 lies in a region of the outsole where less support is needed (and loads are generally lower), shoe 10 is made lighter by exposing a portion of midsole 14 in this manner. As seen in FIG. 7, outsole 22 has a heel region 28 which, when shoe 10 is worn by a properly fitted wearer, rests generally over the wearer's heel. Similarly, outsole 22 has midfoot, forefoot and toe regions 30, 32 and 34 that generally correspond to those portions of a wearer's foot. Extending across cleat assembly 16 from the lateral to medial sides, and located approximately between the forefoot and toe regions, is a flexure region 36. In the embodiment shown, flexure region 36 is formed by locally reducing the thickness of material from which cleat assembly 16 is formed.

Figure 14:
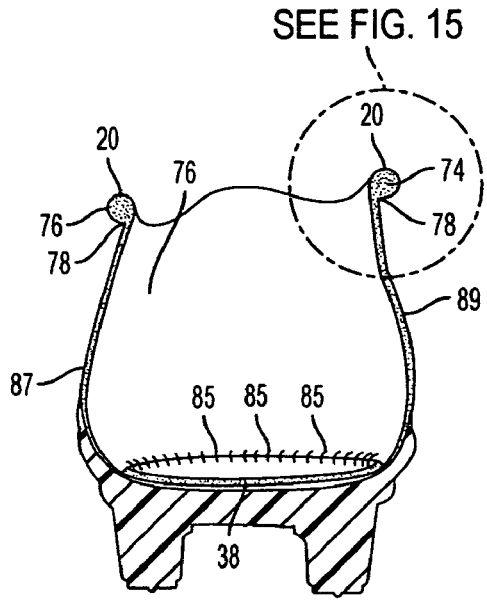
FIG. 14 is a section taken along lines 14—14 of FIG. 4.

FIG. 8 is an exploded perspective view of shoe 10 showing upper 12, air cushion 44, midsole 14 and cleat assembly 16. As seen in FIGS. 4 and 14, upper 12 is, in at least one embodiment, affixed to "Strobel sock" 38. Strobel sock 38 is roughly the shape of a wearer's foot, and closes the bottom of the upper. In at least one embodiment, Strobel sock 38 is Strobel stitched to upper 12 along the periphery of Strobel sock 38 with stitching 85 (FIGS. 4, 14). In that embodiment, a lasting board 35 or other board-like member is located in the toe region 34 proximal to the metatarsal heads of a wearer's foot, and does not extend beyond the forward-most portion of the Strobel sock, as is generally seen in FIG. 8. The location of lasting board 35 in such embodiments is also shown generally in FIG. 7. Upper 12 and attached Strobel sock 38 are adhesively bonded to the upper surface 40 of midsole 14 (FIG. 8). The lower surface 42 (FIG. 9) of midsole 14 is adhesively bonded to cleat assembly 16. In at least one embodiment, cleat assembly 16 and midsole 14 are first bonded before upper 12 is bonded to midsole 14. Although not shown in the FIGS., at least one embodiment of shoe 10 includes a removable sock liner. As is known in the art, a sock liner conforms to and lines the inner bottom surface of a shoe and is the component contacted by the sole (or socked sole) of a wearer's foot.

Midsole 14 is, in one embodiment, a one-piece member formed from a heated and compressed ethylene vinyl acetate (EVA) foam, also known as Phylon. In other embodiments, midsole 14 can be formed from polyurethane foam. Midsole 14 may also have a "skin" layer used for, e.g., coloring. In one embodiment, the thickness of midsole 14 varies from approximately 4 to 6 mm in the heel region to approximately 2 to 3 mm in the toe region. Midsole 14 has a minimum height in forward portions of the side regions so as to be unobtrusive. Increased height in the midfoot regions provides additional support and cushioning. Situated between midsole 14 and upper 12 is an air cushion 44. In at least one embodiment, air cushion 44 is a low profile air cushion having a height of approximately 5 mm. As seen in FIG. 8, air cushion 44 may rest in a depression formed in midsole 14. In at least one embodiment, the combined thickness of midsole 14 and air cushion 44 is 8–10 mm.

FIG. 9 is an inverted exploded view of cleat assembly 16 and midsole 14. Cleat assembly 16 includes a base plate 46, medial support bar 48, lateral support bar 50 and connecting matrix 54. In at least one embodiment, ground engaging members 18 are formed as integral components of base plate 46, and extend through apertures 19 in support bars 48, 50 and through holes in connecting matrix 54. Connecting matrix 54 holds medial and lateral support bars 48 and 50, and includes an opening 53 exposing a central portion of base plate 46. Base plate 46 provides a support structure for ground engaging members 18, as well as an upper surface area 52 (FIG. 8) for bonding to lower surface 42 of midsole 14. Although base plate 46 provides some support for the foot of the wearer, base plate 46 is generally more flexible than medial and lateral support bars 48 and 50, as described below. In one embodiment, base plate 46 is molded from materials such as thermoplastic polyurethane (TPU) having a 92–98 durometer hardness. Connecting matrix 54 covers support bars 48 and 50 and portions of base plate 46. In at least one embodiment, cleat assembly 16 is formed by first molding connecting matrix 54. Support bars 48 and 50 are then molded into connecting matrix 54. Finally, base plate 46 is molded into the already-formed connecting matrix 54 and support bars 48, 50. Connecting matrix 54 extends beyond the peripheral edges of base plate 46 and is bonded to midsole 14 at the edges of base plate 46.

Medial support bar 48 and lateral support bar 50 are attached to (or embedded within) connecting matrix 54. Medial and lateral support bars 48 and 50 are, in at least one embodiment, formed from a material that is stiffer than the material from which base plate 46 is formed (e.g., for same-sized samples of the two materials under identical bending loads, the support bar material deflects less than the base plate material). In one embodiment, support bars 48 and 50 are formed from TPU having a higher modulus of elasticity than the material from which base plate 46 is formed. In other embodiments, support bars 48 and 50 are formed from nylon. In still other embodiments, bars 48 and 50 may be formed from other materials, such as glass fiber reinforced plastic. Medial and lateral support bars 50 could also be formed from dissimilar materials, i.e., medial support bar 48 could be formed from a first material and lateral support bar 50 formed from a second material. After assembly, medial and lateral support bars 48 and 50 are completely enclosed by connecting matrix 54 and base plate 46. In at least one embodiment, connecting matrix 54 is clear or translucent and is formed from TPU having a 95–98 durometer hardness. In the FIGS., connecting matrix 54 is treated as opaque so as not to unduly obscure the drawings. However, and as shown in FIGS. 1–7, matrix material 54 is also applied such that the outlines and shapes of support bars 48 and 50 are still visible. By forming connecting matrix 54 from a clear or translucent material and/or applying the material so as to reveal the shapes of support bars 48 and 50, the support bars remain visible and apparent to a potential purchaser of shoe 10. In other embodiments, connecting matrix 54 could be thicker, and/or medial and lateral support bars 48 and 50 could be completely embedded in connecting matrix 54 (i.e., no portion of bars 48 and 50 is contacted by base plate 46). In still other embodiments, instead of separately forming medial and lateral support bars 48 and 50 in a preformed connecting matrix, the support bars could be formed as areas of increased thickness in the same areas of matrix 54 to which support bars 48 and 50 are added in the embodiments shown in the drawings. In still other embodiments, ground penetrating members 18 would not protrude through apertures in support bars 48 and 50, but would instead be attached to the surfaces of support bars 48 and 50. Ground penetrating members 18 could also be removable, with receptacle attachment points bonded to base plate 46, support bars 48 and 50 and/or connecting matrix 54. Ground penetrating members 18 could also be telescopic; examples of such ground penetrating members are described in published U.S. Patent Application 2003/0093925 (titled "Article of Footwear with a Ground-Engaging Member and Method of Altering a Ground-Engaging Member").

As also seen in FIG. 9, ground-penetrating members may be joined by bridging elements 39. Bridging elements 39, which stabilize and stiffen the ground-engaging members that they join, may be formed as part of connecting matrix 54 and/or as part of base plate 46. As shown in FIG. 9, at least one ground-engaging member 18 is stiffened by gussets 41 formed as part of base plate 46.

Figure 13:
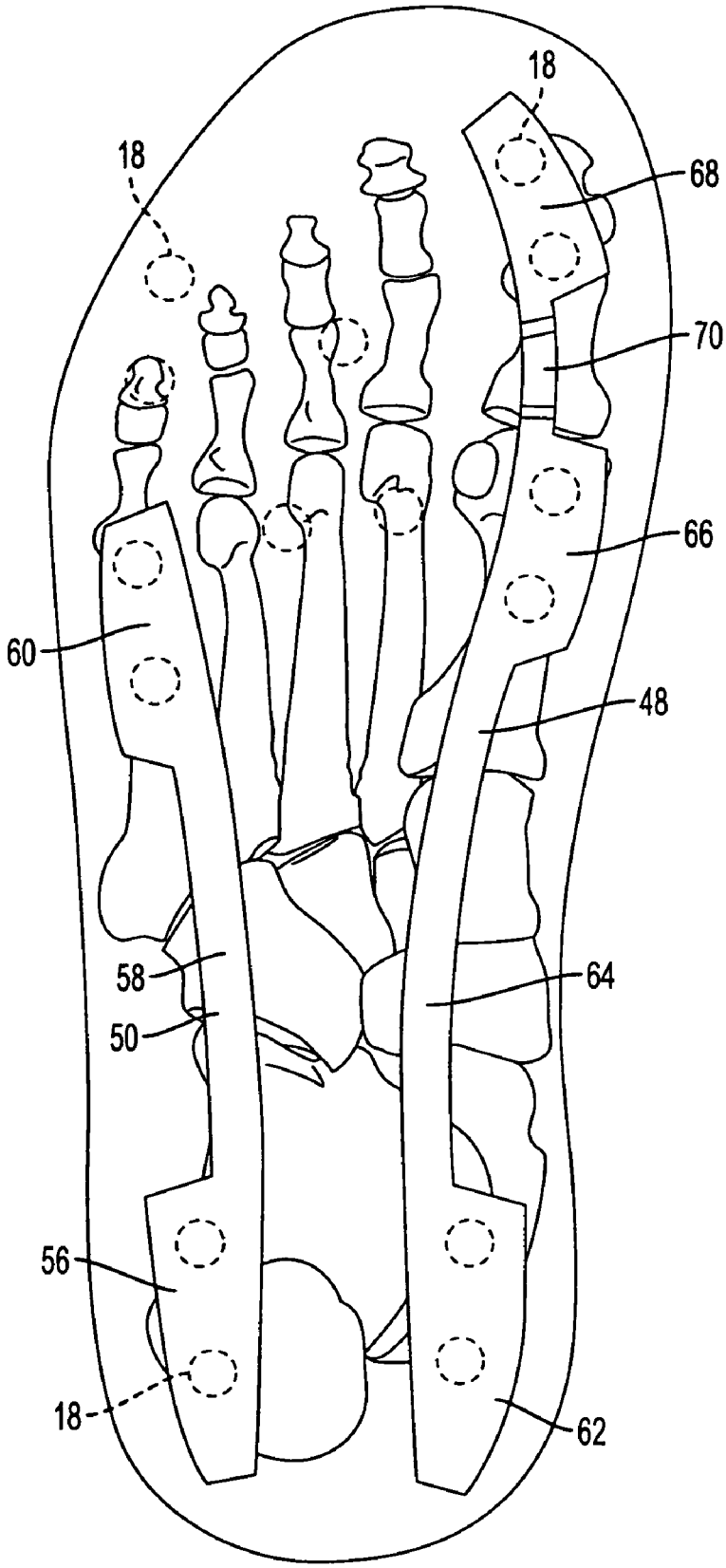
FIG. 13 is a bottom view of bones of a human foot with superimposed components of an article of footwear according to at least one embodiment of the invention.

As seen in FIGS. 7, 9 and 13, lateral support bar 50 includes a heel section 56, a midfoot section 58 and a forefoot section 60. Heel section 56 and forefoot section 60 are widened with respect to midfoot section 58, and two ground engaging members 18 are located within each of those widened sections. Midfoot section 58 is slightly narrower than heel and forefoot sections 56 and 60. Medial support bar 48 is longer than lateral support bar 50, but also includes respective heel, midfoot and forefoot sections 62, 64 and 66. Medial support bar 48 further includes a toe section 68 and a flexure section 70. As with lateral support bar 50, the heel and forefoot sections 62 and 66 of medial support bar 48 are widened with respect to midfoot section 64 and two ground penetrating members 18 located within each of those widened sections. Midfoot section 64 (which may actually extend under the wearer's forefoot) is likewise narrower than adjacent heel and forefoot sections 62 and 66.

Figure 11:
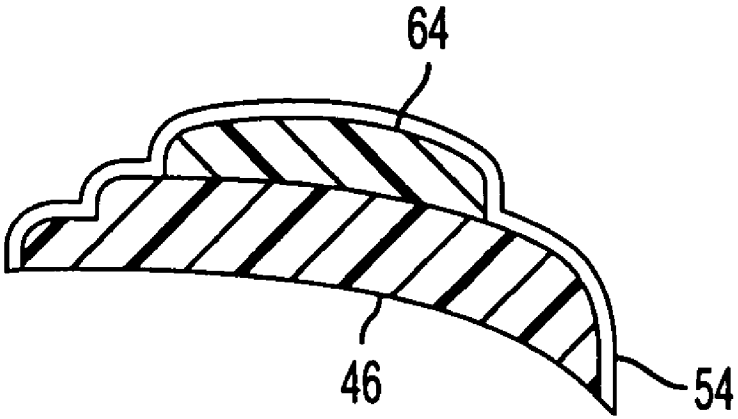
FIG. 11 is a cross section taken along lines 11—11 of FIG. 7.
Figure 10:
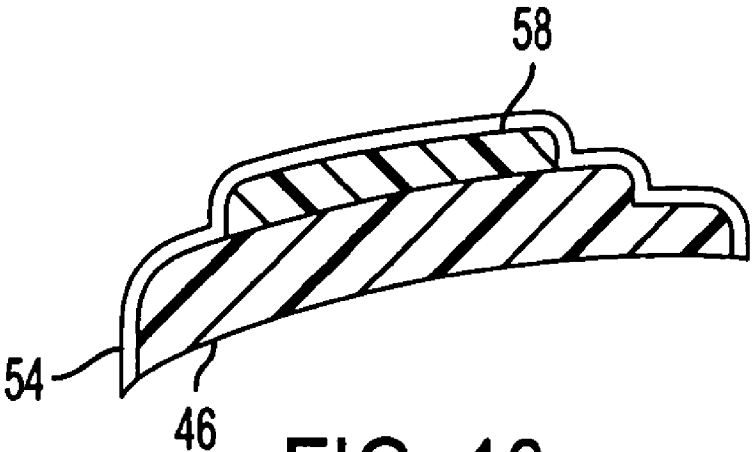
FIG. 10 is a cross section taken along lines 10—10 of FIG. 7.

Cleat assembly 16 includes medial and lateral stiffened sections that are generally located in regions corresponding to the midfoot sections 64 and 58 of respective medial and lateral support bars 48 and 50. In some embodiments, this is achieved by making midfoot section 64 of medial support bar 48 stiffer than midfoot section 58 of lateral support bar 50. In particular, and as seen by comparing FIG. 10 (a cross section taken along lines 10—10 of FIG. 7) with FIG. 11 (a cross section taken along lines 11—11 of FIG. 7), midfoot section 58 of lateral support bar 50 (FIG. 10) is less thick than midfoot section 64 of medial support bar 48 (FIG. 11). In other embodiments, midfoot section 58 and midfoot section 64 are approximately the same thickness. In such embodiments, the portion of connecting matrix 54 overlaying midfoot section 64 (of medial support bar 48) is thicker than the portion of connecting matrix 54 overlaying midfoot section 58 (of lateral support bar 50). In that embodiment, and for male shoe sizes from 8 to 10, midfoot sections 58 and 64 are approximately 1.5 mm thick; the regions of base plate 46 under midfoot sections 58 and 64 are approximately 1.5 mm thick; the portion of connecting matrix 54 over midfoot section 58 is approximately 1.5 mm thick; and the portion of connecting matrix 54 over midfoot section 64 is approximately 3 mm thick. In larger shoe sizes, the component thickness are increased sufficient to maintain the stiffness of the medial and lateral stiffened sections across longer spans corresponding to larger shoe sizes.

Figure 12:
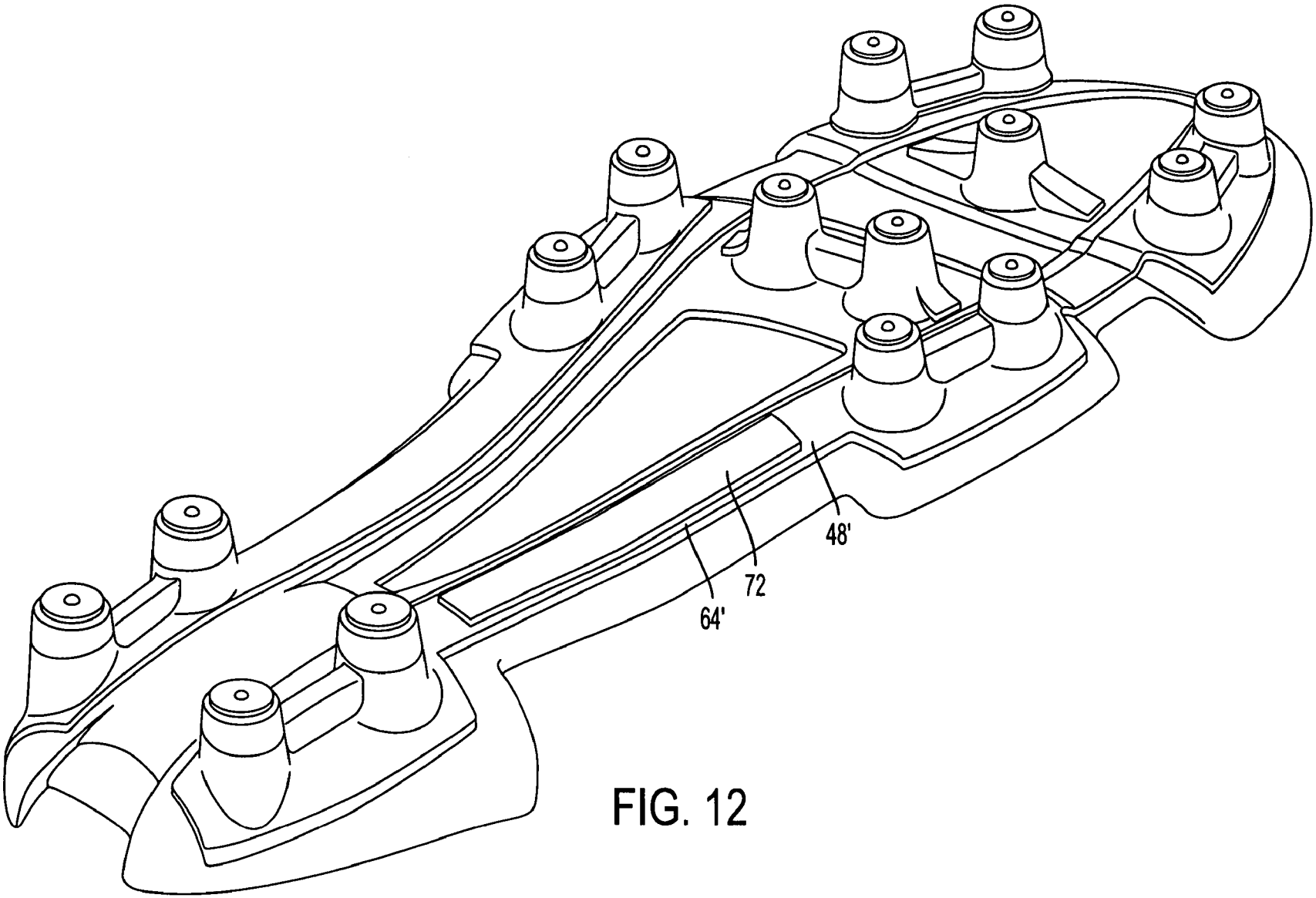
FIG. 12 is an inverted perspective view of an outsole and midsole according to another embodiment of the invention.

In yet another embodiment shown in FIG. 12, an additional stiffening member 72 is attached to midfoot section 64' of medial support bar 48'. In that embodiment, stiffening member 72 is formed from a nickel-titanium alloy (nitinol) strip and bonded to (or embedded in) the outer portion of midfoot section 64' of medial support bar 48'. For a given stiffness of a support bar component, and assuming Young's moduli for nitinol of 41,000–75,000 Mpa and for TPU of 360 Mpa, it is estimated that the thickness of a support bar (or at least a midfoot portion thereof) could be reduced by approximately ⅕ if nitinol is used.

In other embodiments, the thickness of medial midsection 64 is not constant. By increasing the thickness of midsection 64 from heel toward the forefoot, for example, the stiffness of medial support bar midsection 64 also increases toward the forefoot. The thickness of lateral midsection 58 could likewise be non-constant.

Medial support bar 48 further includes a broadened toe section 68 joined to forefoot section 66 by flexure section 70. Located in toe section 68 are two ground penetrating members 18. Flexure section 70 coincides with flexure region 36 so that, overall, the coinciding portions are more flexible than other portions of cleat assembly 16. In at least one embodiment, lateral and medial support bars 50 and 48 are not connected other than by their common attachment to base plate 46 and by connecting matrix 54. In other words, no integral extensions of either support bar join the two bars, and no other bars or support members bridge support bars 48 and 50.

FIG. 13 shows medial and lateral support bars 48 and 50 and ground engaging members 18 overlaid on the foot bones of a properly-fitted wearer of shoe 10. Support bars 48 and 50 are positioned to comfortably support the wearer. Lateral support bar 50 extends from beneath the rear side of the wearer's calcaneous (heel bone) to approximately the end of the wearer's fifth metatarsal. Medial support bar 48 extends from beneath the rear side of the wearer's calcaneous and along the first metatarsal to the first distal phalanges (the bone of the big toe). Notably, the majority of ground engaging members 18 are located within medial and lateral support bars 48 and 50. In this manner, support bars 48 and 50 provide additional bracing for ground-engaging members 18 on the edges of the wearer's foot. Moreover, support bars 48 and 50 are located near the outside edges of the wearer's foot and placed and sized to predictably control foot motion.

As the wearer runs, the lateral edge of the foot will typically strike the ground first. As the wearer moves forward and continues to put more weight on the foot, the natural motion of the foot causes the foot to roll inward toward the medial side, thus flattening out the sole on the ground. By increasing the stiffness of appropriate sections of a medial portion of cleat assembly 16, the flattening out of the foot (i.e., pronation) is reduced.

Figure 15:
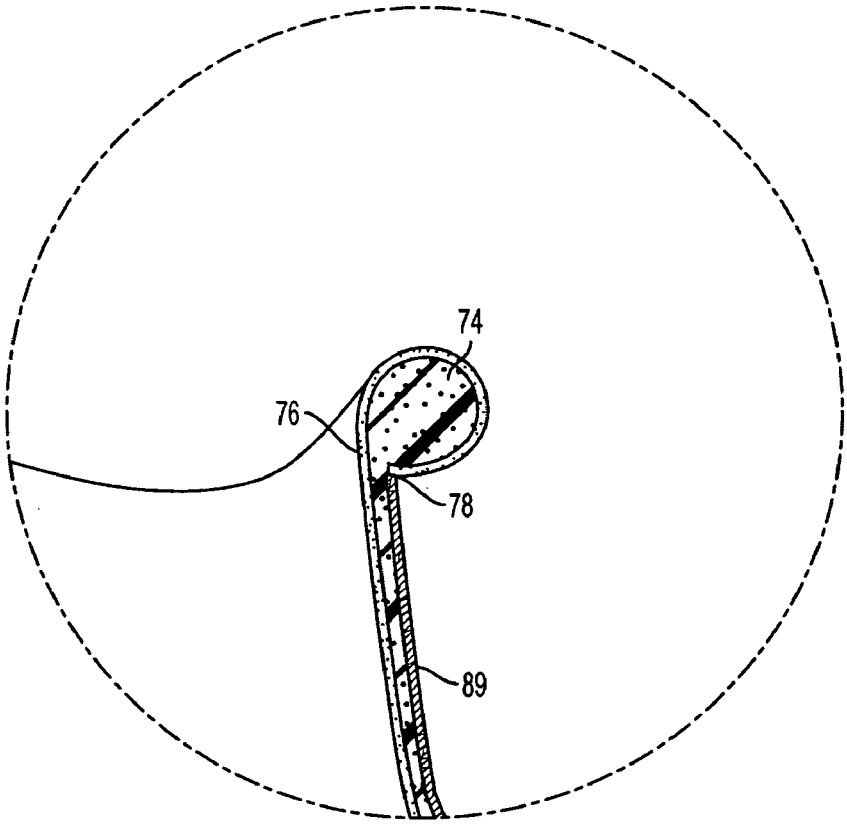
FIG. 15 is an enlarged view of the portion indicated in FIG. 14.

According to another aspect of the invention, comfort is increased for the wearer of shoe 10 by reducing points of irritation around the wearer's ankles (where collar 20 of shoe 10 may be tightly cinched around the wearer's foot) and around the sides of the wearer's heels. Because a soccer player may run 70 km or more per week in his or her soccer shoes, exposed stitching and other discontinuities in these regions can become irritating to the wearer. By reducing these discontinuities around the heel and under the collar, wearer comfort can be enhanced. FIG. 14 is a cross section of shoe 10 taken along lines 14—14 of FIG. 4. So as not to obscure FIG. 14 with unnecessary details, separate sections for the various components of midsole 14 and cleat assembly 16 are not shown. As seen on the left side of FIG. 14 (which corresponds to the lateral side of shoe 10), upper 12 includes a lateral exterior portion 87, an inner lining 76 and padding 74. Similarly, the right side of FIG. 14 shows medial exterior portion 89, padding 74 and lining 76. FIG. 15 is an enlarged view of the portion indicated by the broken line circle in FIG. 14, and schematically illustrates inner lining 76, padding 74 and exterior portion 89. In one embodiment, lining 76 is a single piece and is attached to exterior portions 87, 89 at seam 78. Padding 74 is situated between lining 76 and exterior portions 87, 89, and is secured in placed with adhesive. A bead is formed in padding 74 by seam 78, thereby creating collar 20. Padding 74 thins toward Strobel sock 38. In the embodiment shown, lining 76 extends to (and is sewn by) stitching 85 that attaches Strobel sock 38 to exterior portions 87, 89 of upper 12. Lining 76 covers an interior area of shoe 10 generally corresponding to the heel counter, and forms an area around the inside heel area of shoe 10 that is substantially free of stitching, seams or other potentially irritating discontinuities. Forward of the heel counter, lining 76 continues below collar 20 (although not necessarily all the way to Strobel sock 38) so as to continue the discontinuity-free region in the area around the portion of shoe 10 that is cinched tightly around a wearer's ankle. In one embodiment, a closed-cell high density foam material such as ethylene propylene diene monomer (EPDM) is used to form padding 74. In other embodiments, padding 74 is BU synthetic or neoprene foam. Lining 76 is a polyurethane-coated polyester in one embodiment.

Midsole 14, because it is formed from a heated and compressed EVA foam or similar material, is sufficiently stiff so as to provide support for the wearer's foot. However, the residual compressibility of the material also provides cushioning. By eliminating a full-length lasting board or other firm full-length insole material, and by bonding the Strobel sock directly to the cushioning midsole (except in the region of air cushion 44), wearer comfort is substantially enhanced. In comparison of a shoe according to the invention with more conventional designs having a full-length firm insole, stud pressure caused by ground engaging members is believed to be reduced. Moreover, the invention reduces reliance upon a sock liner to provide most of the cushioning from stud pressure. Typically, sock liners have a life that is shorter than the remainder of the shoe.

While the various features of shoe 10 work together to achieve the advantages previously described, it is recognized that individual features and sub-combinations of these features can be used to obtain some of the aforementioned advantages without the necessity to adopt all of these features.

While particular embodiments of the invention have been shown and described, it is recognized that various modifications thereof will occur to those skilled in the art. Therefore, the scope of the herein-described invention shall be limited solely by the claims appended hereto.

We claim:

1. An article of footwear comprising:

a cleat assembly;

a compressible midsole covering substantially the entire sole of a wearer's foot, the compressible midsole bonded to the cleat assembly and providing cushioning in at least a midfoot region; and an upper including a peripherally-stitched Strobel sock and a lasting board in a toe region proximal to the metatarsal heads of a wearer's foot, wherein the lasting board does not extend beyond the forward-most portion of the Strobel sock, and the upper is adhesively bonded directly to the cushioning midsole.

2. The article of footwear of claim 1, wherein the cushioning midsole comprises a closed-cell compressed foam element.

3. The article of footwear of claim 2, further comprising an air cushion, wherein:

the cushioning midsole comprises toe and heel regions, the air cushion is generally located in the heel region between the upper and the midsole, the foam element is approximately 2–3 mm thick in the toe region, and the combined thickness of the foam element and air cushion is approximately 8–10 mm.

4. The article of footwear of claim 2, wherein the cushioning midsole comprises heated and compressed ethylene vinyl acetate foam.

5. The article of footwear of claim 1, wherein the midsole includes integral portions extending upward along sides of the wearer's foot along a substantial portion of the periphery of the midsole, the upwardly extending midsole portions including:

a first side portion located along a medial forefoot region, a second side portion located along a lateral forefoot region, and a heel portion joining the first and second side portions.

6. The article of footwear of claim 1, wherein the upper further includes:

a padded collar element, a lining covering the collar and extending inside a portion of a foot-receiving region of the article corresponding to a heel counter, the portion of the foot-receiving region corresponding to the heel counter being substantially free of discontinuities.

7. The article of footwear of claim 6, wherein the padded collar element is padded with a closed cell foam.

8. The article of footwear of claim 1, wherein the upper is tongueless, the upper wraps from the medial side of the wearer's foot, over the top of the foot, and under a lateral side portion of the upper, and the laces are located on a lateral side of the upper.

9. An article of footwear comprising:

a cleat assembly;

a compressible midsole formed from a closed-cell foam, wherein the midsole covers substantially the entire sole of a wearer's foot, the midsole includes integral portions extending upward along sides of the wearer's foot along a substantial portion of the periphery of the midsole, the upwardly extending midsole portions including a first side portion located along a medial forefoot region, a second side portion located along a lateral forefoot region, and a heel portion joining the first and second side portions, the compressible midsole is adhesively bonded to the cleat assembly and provides cushioning in at least a midfoot region; and an upper including a peripherally-stitched Strobel sock and a lasting board in a toe region proximal to the metatarsal heads of a wearer's foot, wherein the lasting board does not extend beyond the forwardmost portion of the Strobel sock, the upper is adhesively bonded directly to the cushioning midsole, the upper includes a padded collar element, the upper includes a lining covering the collar and extending inside a portion of a foot-receiving region of the article corresponding to a heel counter, the portion of the foot-receiving region corresponding to the heel counter being substantially free of discontinuities, the upper is tongueless, the upper wraps from the medial side of the wearer's foot, over the top of the foot, and under a lateral side portion of the upper, and the laces are located on a lateral side of the upper.

* * * * *